US009188067B2

(12) United States Patent
Woo et al.

(10) Patent No.: US 9,188,067 B2
(45) Date of Patent: Nov. 17, 2015

(54) VARIABLE COMPRESSION RATIO DEVICE AND INTERNAL COMBUSTION ENGINE INCLUDING THE SAME

(71) Applicant: Hyundai Motor Company, Seoul (KR)

(72) Inventors: Yoonsik Woo, Yongin-si (KR); Eun Ho Lee, Suwon-si (KR); Han Sang Kim, Ansan-si (KR); Yun Seok Kim, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 68 days.

(21) Appl. No.: 14/089,134

(22) Filed: Nov. 25, 2013

(65) Prior Publication Data

US 2014/0238355 A1 Aug. 28, 2014

(30) Foreign Application Priority Data

Feb. 28, 2013 (KR) ..... 10-2013-0022420

(51) Int. Cl.
*F02D 15/02* (2006.01)
*F02D 15/04* (2006.01)

(52) U.S. Cl.
CPC ..... *F02D 15/04* (2013.01)

(58) Field of Classification Search
CPC ..... F02D 17/00; F02D 15/02; F02D 15/04; F02B 75/04
USPC .... 123/48 R, 48 A, 48 AA, 48 B, 78 R, 78 A, 123/78 AA, 78 B
See application file for complete search history.

(56) References Cited

U.S. PATENT DOCUMENTS 3,450,111 A * 6/1969 Cronstedt ..... 123/78 R
3,704,695 A * 12/1972 Cronstedt ..... 123/78 B
4,241,705 A * 12/1980 Karaba et al. ..... 123/78 B
7,284,512 B2 10/2007 Hirano

FOREIGN PATENT DOCUMENTS

KR 10-2004-0021639 A 3/2004
KR 10-2009-0060609 A 6/2009

* cited by examiner

*Primary Examiner* — Marguerite McMahon
(74) *Attorney, Agent, or Firm* — Morgan, Lewis & Bockius LLP

(57) ABSTRACT

A variable compression ratio device may include a piston assembly having double pistons of which the volume may be varied, a lifter relatively moving one piston of the double pistons with respect to the other piston of the double pistons, a guide unit engaged with the piston assembly and guiding a movement of the one piston with respect to the other piston, and a locking unit selectively coupling the one piston to the other piston.

9 Claims, 2 Drawing Sheets

VARIABLE COMPRESSION RATIO DEVICE AND INTERNAL COMBUSTION ENGINE INCLUDING THE SAME

CROSS-REFERENCE TO RELATED APPLICATION

The present application claims priority to Korean Patent Application No. 10-2013-0022420 filed on Feb. 28, 2013, the entire contents of which is incorporated herein for all purposes by this reference.

BACKGROUND OF THE INVENTION

1. Field of the Invention

The present invention relates to a variable compression ratio device, and more particularly, to a variable compression ratio device capable of varying a compression ratio by varying a protrusion height of an inner piston which is coupled to an outer piston so as to move in an axial direction, and an internal combustion engine including the same.

2. Description of Related Art

In general, a compression ratio of an internal combustion engine is represented by a ratio of a maximum volume of a combustion chamber before compression to a minimum volume of the combustion chamber after compression during a compression stroke of the internal combustion engine.

When the compression ratio of the internal combustion engine is increased, the output of the internal combustion engine increases. However, when the compression ratio of the internal combustion engine is excessively high, a so-called knocking may occur to reduce the output of the internal combustion engine. Furthermore, the internal combustion engine may be overheated or a valve or piston trouble may occur in the internal combustion engine.

Thus, the compression ratio of the internal combustion engine is set to a specific value within a proper range before a knocking occurs. When the compression ratio is properly varied according to a load of the internal combustion engine, the fuel efficiency and output of the internal combustion engine may be improved. Therefore, various methods for varying the compression ratio of the internal combustion engine have been proposed.

The methods for varying the compression ratio of the internal combustion engine may include methods for varying the volume of a combustion chamber during a compression stroke.

For example, the level of top dead center of the piston may be varied during the compression stroke, or the volume of a secondary combustion chamber provided in a cylinder head may be increased or decreased.

U.S. Pat. No. 7,284,512 has disclosed a double piston structure having an outer piston and an inner piston, and the outer piston varies a compression ratio while moved vertically by a hydraulic actuator.

The variable compression ratio device having the above-described double piston structure requires a structural improvement for response and durability.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable compression ratio device capable of reducing the weight and cost thereof through a simplified structure and improving response, operation reliability, and durability, and an internal combustion engine including the same.

In an aspect of the present invention, a variable compression ratio device may include a piston assembly having double pistons of which the volume is varied, a lifter relatively moving one piston of the double pistons with respect to the other piston of the double pistons, a guide unit engaged with the piston assembly and guiding a movement of the one piston with respect to the other piston, and a locking unit selectively coupling the one piston to the other piston.

The double piston may include an outer piston, and an inner piston slidably coupled to the outer piston so as to protrude from the outer piston to the outside of the outer piston.

The outer piston may include an opening formed at a top thereof, and a housing groove formed in the outer piston, wherein the inner piston is inserted through the opening and mounted in the housing groove.

The guide unit may include a pinion gear rotatably mounted on an exterior circumference of the inner piston, and a rack gear mounted in the outer piston so as to be engaged with the pinion gear.

The lifter may include a wax or bimetal which pushes the inner piston upward through the opening in receiving an electrical signal.

The wax or bimetal is formed in a plate shape, and the inner piston is supported by the wax or bimetal.

The locking unit may include a solenoid installed in the outer piston and selectively protruding toward the housing groove in receiving an electrical signal, and a locking groove formed in the inner piston such that the solenoid is selectively coupled to the locking groove to lock the outer piston and the inner piston.

The variable compression ratio device may further include an engine control unit (ECU) detecting an operation state of an engine and applying an electrical signal to the lifter and the locking unit such that the volume of the piston is varied according to the operation state of the engine.

The ECU varies a compression ratio by controlling a magnitude of the electrical signal applied to the lifter according to the operation state of the engine.

An internal combustion engine may include a cylinder block having the piston assembly, the piston assembly being housed to reciprocate along the cylinder block, and a cylinder head coupled to the top of the cylinder block and forming a combustion chamber with the cylinder block.

In the variable compression ratio device and the internal combustion engine including the same according to the embodiments of the present invention, as the flexible member is extended in the axial direction of the connecting rod according to the control signal of the ECU, the internal piston is lifted to increase the compression ratio. When the flexible member is contracted in the axial direction of the connecting rod, the inner piston is lowered to decrease the compression ratio.

Thus, the structure may be simplified to reduce the weight and cost of a vehicle and improve the durability and operation reliability.

Furthermore, since the variable compression ratio device is operated according to an electrical signal, the response thereof may be improved. The variable compression ratio device may control the compression ratio according to the operation situation of the engine, thereby improving the output and fuel efficiency of the engine.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
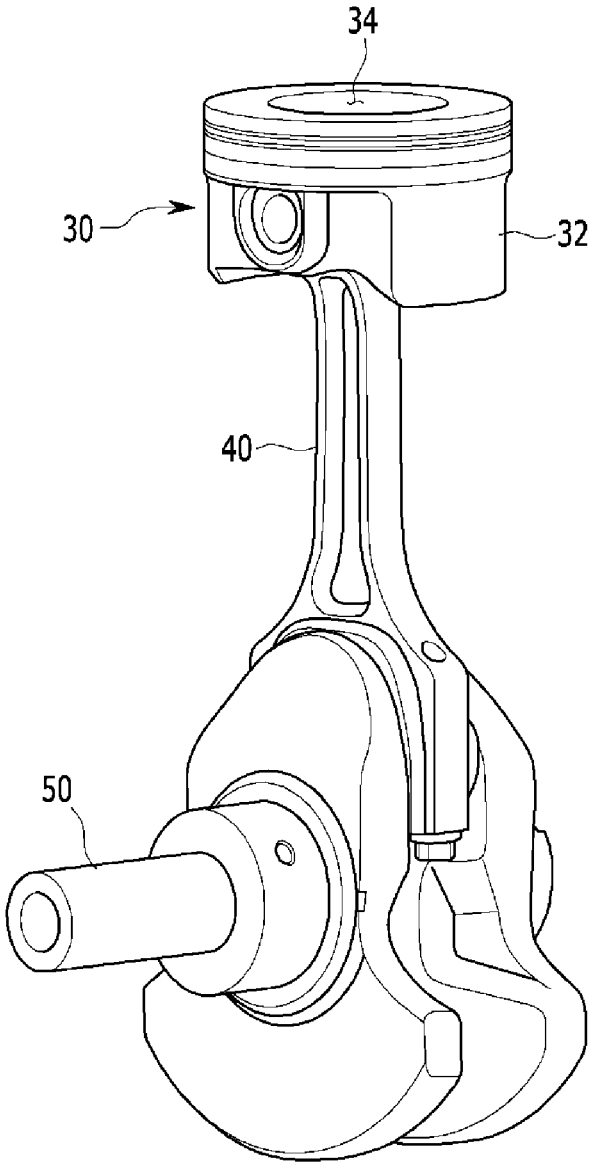
FIG. 1 is a perspective view illustrating that a piston to which a variable compression ratio device according to an exemplary embodiment of the present invention is applied is coupled to a connecting rod and a crankshaft.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, exemplary embodiments of the present invention will be described in detail with reference to the accompanying drawings.

Figure 2:
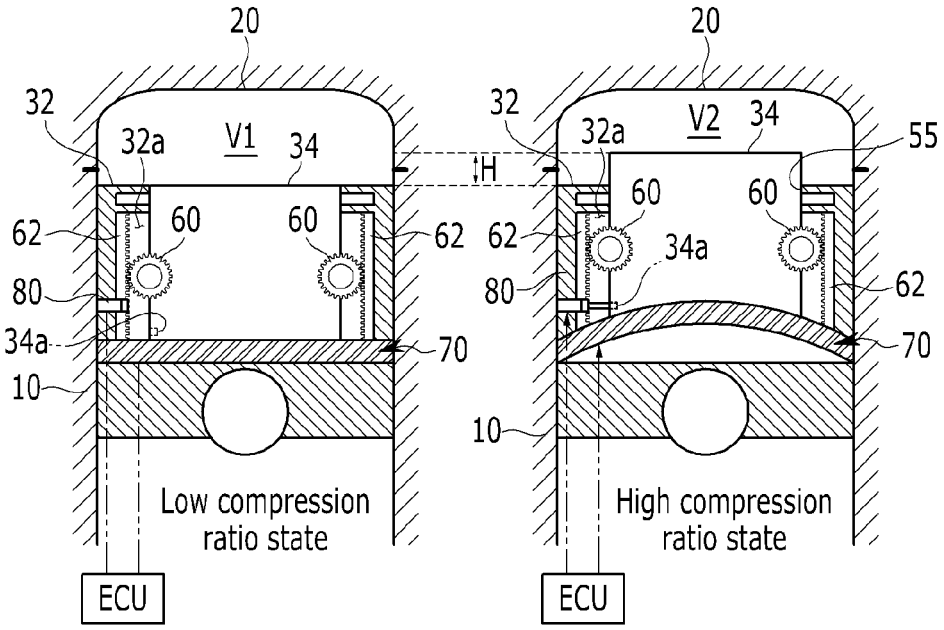
FIG. 2 is a cross-sectional view of the piston which realizes a low compression ratio state and a high compression ratio state through the variable compression ratio device according to the exemplary embodiment of the present invention.

Referring to FIGS. 1 and 2, a cylinder head 20 is mounted over a cylinder block 10 constituting an engine, thereby forming a combustion chamber.

A piston 30 is inserted into the cylinder block 10 so as to reciprocate vertically along the cylinder block 10. One end of a connecting rod 40 is connected to the piston 30 through a piston pin or the like so as to move as one unit, and the other end of the connecting rod 40 is coupled to a crankshaft 50.

When the piston 30 reciprocates along the cylinder block 10, the connecting rod 40 converts the reciprocating operation of the piston 30 into a rotating operation to rotate the crankshaft 50, and the crankshaft 50 generates a rotation power while rotated in one direction.

When the piston 30 rises or drops along the cylinder block 10, the volume of the combustion chamber is varied by the piston 30.

When the volume of the combustion chamber formed by the cylinder 10, the cylinder head 20, and the piston 30 is varied at the time at which the piston 30 is moved toward the top of the combustion chamber and positioned at the top dead center, the compression ratio of the engine is varied.

According to the exemplary embodiment of the present invention, when the piston 30 is positioned at the top dead center, the volume of the piston 30 may be varied to control the compression ratio of the engine.

That is, the piston 30 is a volume variable piston.

The volume variable piston 30 has a double piston structure to vary the volume thereof.

That is, the piston 30 includes an outer piston 32 and an inner piston 34.

The outer piston 32 has an opening 55 formed at the top thereof and a housing groove 32*a* formed therein to communicate with the opening 55. The housing groove 32*a* is expanded in a radial direction to have a larger diameter than that of the inner piston 34, and extended in an axial direction.

The inner piston 34 is inserted through the upper opening of the outer piston 32 and housed in the housing groove 32*a*.

The inner piston 34 is installed to relatively move in an axial direction with respect to the outer piston 32 in a state in which the inner piston 34 is housed in the housing groove 32*a*.

A guide unit is provided between the inner piston 34 and the outer piston 32 so as to guide the movement of the inner piston 34.

The guide unit includes a pinion gear 60 mounted on the exterior circumference of the inner piston 34 positioned in the housing groove 32*a* and a rack gear 62 mounted on the exterior circumference of the housing groove 32*a* facing the exterior circumference of the inner piston 34 and engaged with the pinion gear 60.

When the inner piston 34 is relatively moved with respect to the outer piston 32, the pinion gear 60 is moved along the rack gear 62 in a state where the pinion gear 60 is engaged with the rack gear 62, thereby guiding the movement of the inner piston 34.

A lifter 70 is provided to relatively move the inner piston 34 with respect to the outer piston 32.

The lifter 70 is installed at the bottom of the inner piston 34, and may have a plate shape.

The lifter 70 may include a bimetal plate or wax plate which is deformed to protrude upward in the axial direction when receiving an electrical signal, and pushes the inner piston 34 upward in the axial direction toward the combustion chamber.

A locking unit is provided to maintain the position of the inner piston 34 in a state where the inner piston 34 is pushed upward by the lifter 70.

The locking unit may include a solenoid 80 installed in the outer piston 32 so as to protrude toward the housing groove 32*a* and a locking groove 34*a* formed on the exterior circumference of the inner piston 34. The locking groove 34*a* may have a depressed shape such that the solenoid 80 is detachably coupled to the locking groove 34*a*.

In FIG. 2, a low compression ratio state corresponds to a state in which the inner piston 34 is inserted into the housing groove 32*a* of the outer piston 32 when the outer piston 32 is positioned at the top dead center. In this state, the combustion chamber has a volume V1 formed by the cylinder head 20, the cylinder block 10, the outer piston 32, and the top surface of the inner piston 34.

When an engine control unit (ECU) applies an electrical signal to the lifter 70 at the time at which the outer piston 32 is positioned at the top dead center, the lifter 70 is elastically deformed upward in the axial direction toward the combustion chamber, and the inner piston 34 supported by the lifter 70 is protruded from the housing groove 32*a* of the outer piston 32 upward in the axial direction toward the combustion chamber through the elastic deformation of the lifter 70.

Thus, the volume V2 of the combustion chamber decreases by a volume (V1-V2) corresponding to the protrusion height H of the inner piston 34. Then, a high compression ratio state is realized.

The ECU applies an electrical signal to the solenoid 80 in a state where the inner piston 34 is protruded by the lifter 70, and the solenoid 80 is inserted and locked to the locking groove 34*a* of the inner piston 34 toward the housing groove 32, thereby maintaining the high compression ratio state.

When the electrical signal applied by the ECU is blocked, the lifter 70 and the solenoid 80 are recovered to the original shapes thereof, and the inner piston 34 is housed in the housing groove 32*a* by the weight thereof and the pressure of the compression chamber, thereby realizing the low compression ratio state.

According to the magnitude of the electrical signal applied to the lifter 70 from the ECU, the deformation of the lifter 70 may be varied to control the protrusion height H of the inner piston 34.

For convenience in explanation and accurate definition in the appended claims, the terms "upper", "lower", "inner" and "outer", are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. A variable compression ratio device comprising:

a piston assembly having double pistons of which the volume is varied;

a lifter relatively moving a first piston of the double pistons with respect to a second piston of the double pistons;

a guide unit engaged with the piston assembly and guiding a movement of the first piston with respect to the second piston; and a locking unit selectively coupling the first piston to the second piston, wherein the double pistons include:

an outer piston; and an inner piston slidably coupled to the outer piston so as to protrude from the outer piston to an outside of the outer piston.

2. The variable compression ratio device of claim 1, wherein the outer piston includes:

an opening formed at a top thereof; and a housing groove formed in the outer piston, wherein the inner piston is inserted through the opening and mounted in the housing groove.

3. The variable compression ratio device of claim 1, wherein the guide unit includes:

a pinion gear rotatably mounted on an exterior circumference of the inner piston; and a rack gear mounted in the outer piston so as to be engaged with the pinion gear.

4. The variable compression ratio device of claim 2, wherein the lifter includes a wax or bimetal which pushes the inner piston upward through the opening in receiving an electrical signal.

5. The variable compression ratio device of claim 4, wherein the wax or bimetal is formed in a plate shape, and the inner piston is supported by the wax or bimetal.

6. The variable compression ratio device of claim 2, wherein the locking unit includes:

a solenoid installed in the outer piston and selectively protruding toward the housing groove in receiving an electrical signal; and a locking groove formed in the inner piston such that the solenoid is selectively coupled to the locking groove to lock the outer piston and the inner piston.

7. The variable compression ratio device of claim 1, further including:

an engine control unit (ECU) detecting an operation state of an engine and applying an electrical signal to the lifter and the locking unit such that the volume of the double pistons is varied according to the operation state of the engine.

8. The variable compression ratio device of claim 7, wherein the ECU varies a compression ratio by controlling a magnitude of the electrical signal applied to the lifter according to the operation state of the engine.

9. An internal combustion engine including:

a cylinder block having the piston assembly of claim 1, the piston assembly being housed to reciprocate along the cylinder block; and a cylinder head coupled to a top of the cylinder block and forming a combustion chamber with the cylinder block.

* * * * *